United States Patent [19]

Burkett

[11] 4,338,130

[45] Jul. 6, 1982

[54] PRECIPITATION HARDENING COPPER ALLOYS

[76] Inventor: Richard A. Burkett, 1001 Rohlwing Rd., Rolling Meadows, Ill. 60008

[21] Appl. No.: 208,679

[22] Filed: Nov. 20, 1980

[51] Int. Cl.[3] ..... C22C 9/06

[52] U.S. Cl. ..... 420/486; 148/435

[58] Field of Search ..... 75/159, 160, 162, 153; 148/11.5 C, 12.7 C, 160

[56] References Cited

U.S. PATENT DOCUMENTS

| | | | |
|---|---|---|---|
| 2,031,316 | 2/1936 | Jennison | 75/159 |
| 2,050,601 | 8/1936 | Ellis | 148/12.7 C |
| 2,074,604 | 3/1937 | Bolton et al. | 75/159 |
| 2,430,306 | 11/1947 | Smith | 75/159 |
| 2,851,353 | 9/1958 | Roach et al. | 75/159 |
| 3,072,508 | 1/1963 | Klement et al. | 148/160 |
| 4,191,601 | 3/1980 | Edens et al. | 148/160 |

FOREIGN PATENT DOCUMENTS

| | | | |
|---|---|---|---|
| 471396 | 8/1975 | U.S.S.R. | 75/159 |

*Primary Examiner*—Peter K. Skiff

[57] ABSTRACT

A precipitation and dispersion hardening copper alloy is disclosed which combines useful properties of high tensile and yield strength, proportional limit, modulus of elasticity, ductility and formability, corrosion resistance, and electrical conductivity. The copper alloy consists of 2 to 9% nickel, 0.05 to 2% each of silicon, chromium and aluminum, and balance copper.

5 Claims, 5 Drawing Figures

PRECIPITATION HARDENING COPPER ALLOYS

BACKGROUND OF THE INVENTION

1. Field of the Invention

This invention relates to precipitation and dispersion hardening copper alloys and more particularly to precipitation hardening copper alloys that combine good mechanical and electrical properties.

2. Description of the Prior Art

There are many applications in which a strong resilient part having good electrical conductivity is desired. The superior conductivity of copper would make it an obvious choice were it not for its relatively poor mechanical properties such as comparative softness, low modulus of elasticity and low tensile and tensile yield strengths.

Unlike many kinds of steel, most copper alloys are not susceptible to improvement in hardness and strength by heat treatment processes. One useful exception to this is the copper beryllium alloys which are precipitation or age hardenable. These copper alloys, typically containing between 1 and 2% beryllium, are useful because of their non magnetic properties, good electrical conductivity, high tensile strength, high degree of hardness, and their ability to be cast, wrought, forged or drawn. Because of these properties they find utility in the manufacture of various types of instruments, electrical contact points, coil springs, non magnetic cutting tools and the like.

While copper beryllium alloys have useful mechanical and electrical properties, their cost is comparatively high due to the scarceness of beryllium in the earth's crust. Of even greater concern, is the current recognition that beryllium is an extremely toxic material and a hazardous carcinogen. This makes it difficult to process copper beryllium alloys with conventional techniques without exceeding exposure standards set by OSHA and endangering the health of workers. Copper beryllium alloys present a health hazard not only at the time the alloy is manufactured, but also during subsequent machining which produces air borne metallic dust particles.

Copper alloys using metals other than beryllium also have deficiencies. For example, brasses, phosphor bronzes, nickel silvers and most copper alloys obtain their property increases through cold working, which decreases formability in direct proportion to the amount of cold work. Other dispersion hardening alloys lack sufficient electrical conductivity to be used in electrical applications.

Accordingly, it is an object of this invention to provide a beryllium free precipitation hardenable copper alloy that has mechanical and electrical properties similar to those ordinarily only obtained with copper beryllium alloys.

Another object of this invention is to provide copper alloys that combine useful properties of tensile strength, yield strength, hardness, formability and electrical conductivity.

Another object of this invention is to provide a non toxic, relatively inexpensive, precipitation hardenable copper alloy that has desirable mechanical and electrical properties.

Briefly these and other objects of this invention are achieved by making a copper nickel alloy which includes minor quantities of silicon, chromium and aluminum. To achieve the desired mechanical properties at least 2% nickel (all percentages given herein are based upon weight) is required and the practical upper limit, from the standpoint of electrical conductivity is about 9%. The silicon, chromium and aluminum are all required, at least in small amounts, of from about 1/20% to up to about 2%. Within these limits, a large number of alloys can be made. No specific percentages can be given as ideal since, as is so often the case, an increase or decrease in a particular component is a trade off of one desirable property for another and the exact formulation selected will depend on the end use requirements. In one preferred formulation, however, the total of the silicon, chromium, and aluminum total about 2% or slightly less.

To the fullest extent possible, all but trace amounts of other metals should be excluded from the alloy as even small amounts of elements such as manganese and magnesium which are sometimes included in copper alloys, will significantly reduce conductivity and decrease ductility.

For most end use application, it is generally desired to achieve a conductivity of at least a 14% I.A.C.S. (Internation Association of Conductivity Standards.)

The alloys of this invention have a very complex structure of the various pseudo-binary systems with copper as the base component and the other elements combined in various combinations as the other phases. The alloy has increased solubility at elevated temperatures and this alpha state can be maintained by rapidly quenching to room temperature, thereby creating an unstable, super saturated condition that only requires the proper temperature to precipitate the hardening phases.

The alloys of this invention are readily hardenable at surprisingly short times at elevated temperatures. For example, maximum hardness is obtained in less than 2 hours, but, when the temperature is raised to about 750° C., maximum hardness is developed in only 15 seconds.

IN THE DRAWING

EXAMPLES

Figure 1:
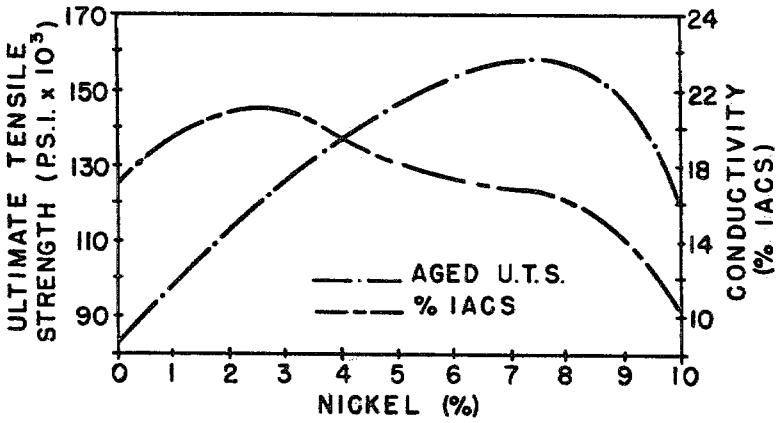
FIG. 1 is a graph showing the effect upon ultimate tensile strength and conductivity when the nickel content of an alloy of this invention is varried as shown along the abscissa and the alloying amounts of Si and Al are held constant at 0.75%, and the Cr at 0.5%.
Figure 2:
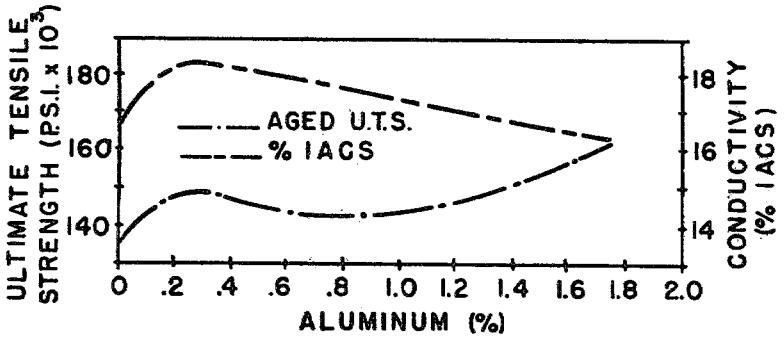
FIG. 2 is a graph showing the effect upon ultimate tensile strength and conductivity when the aluminum content of an alloy of this invention is varried as shown along the abscissa and the Ni is held constant at 5%, the Si at 0.75%, and the Cr at 0.5%.
Figure 3:
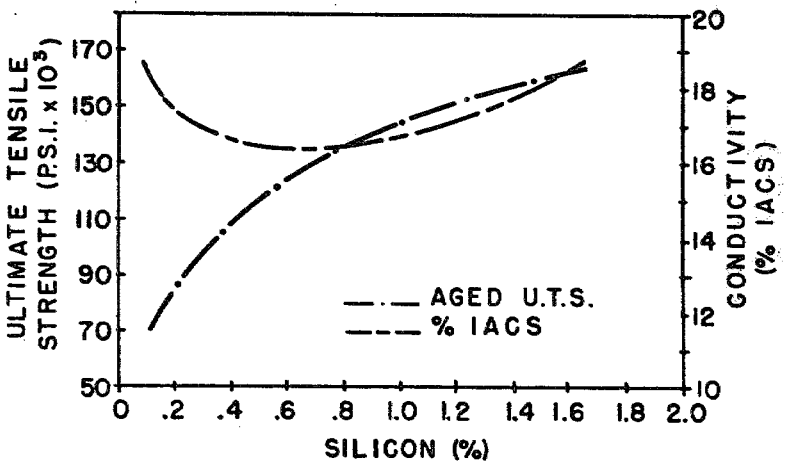
FIG. 3 is a graph showing the effect upon ultimate tensile strength and conductivity when the silicon content of an alloy of this invention is varried as shown along the abscissa and the Ni is held constant at 5% the Al at 0.75% and the Cr at 0.5%.
Figure 4:
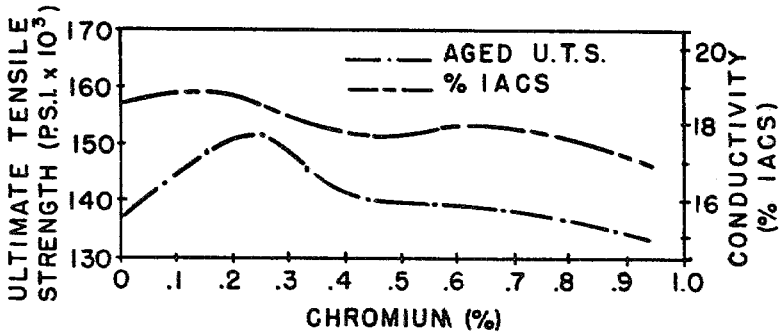
FIG. 4 is a graph showing the effect upon ultimate tensile strength and conductivity when the chromium content of an alloy of this invention is varried, as shown along the abscissa and the Ni content is held constant at 5% and the Al and Si at 0.75%.
Figure 5:
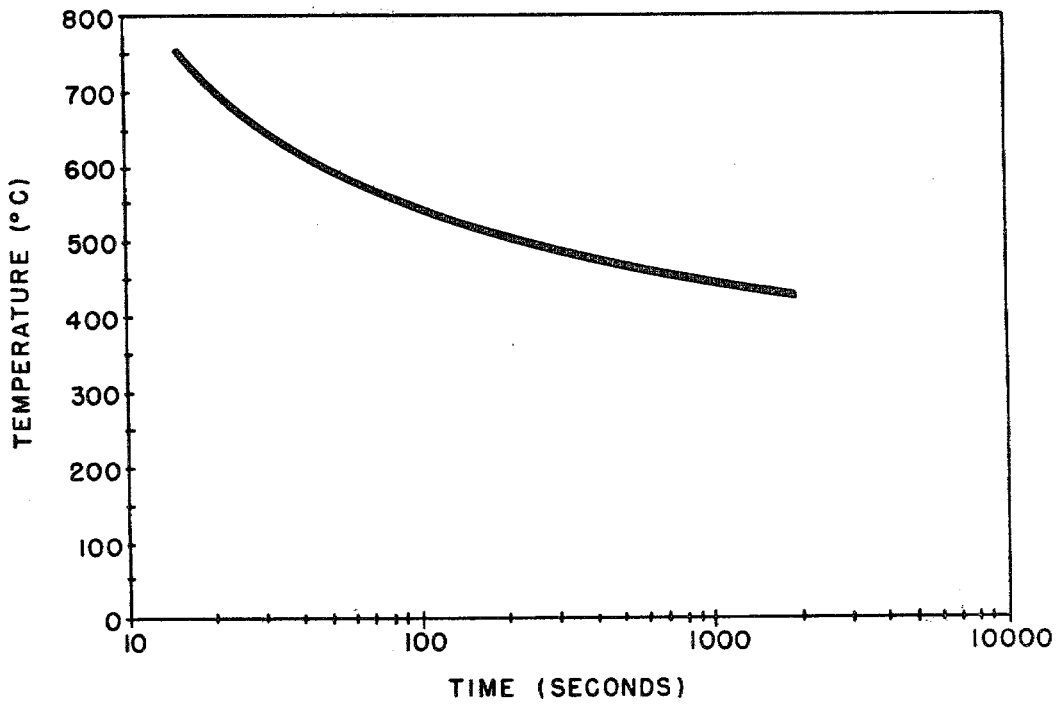
FIG. 5 is a graph showing the time required to achieve maximum hardness of typically alloys of this invention plotted against the function of temperature.

In the following examples, alloys were made in accordance with this invention using standard techniques.

The tabularized values show the variation in properties obtained when the several alloying metals were varried in the amounts as shown. The property data listed was obtained after heat aging at 450° C. for the times shown.

| Cast No. | Ni % | Si % | Al % | Cr % |
|---|---|---|---|---|
| 1 | 5.60 | 0.72 | 1.46 | 0.46 |
| 2 | 5.44 | 0.97 | 1.00 | 0.50 |
| 3 | 5.81 | 0.79 | 0.28 | 0.44 |
| 4 | 5.52 | 0.74 | 0.77 | 0.22 |
| 5 | 5.54 | 0.89 | 0.78 | 0.33 |
| 6 | 5.35 | 1.41 | 0.82 | 0.40 |
| 7 | 5.23 | 1.41 | 0.83 | 0.42 |
| 8 | 5.44 | 1.30 | 0.80 | 0.42 |
| 9 | 5.30 | 0.28 | 0.72 | 0.36 |
| 10 | 2.15 | 0.88 | 0.78 | 0.46 |
| 11 | 3.18 | 0.90 | 0.77 | 0.41 |
| 12 | 4.55 | 0.95 | 0.86 | 0.41 |
| 13 | 4.23 | 1.02 | 0.92 | 0.47 |
| 14 | 8.63 | 1.31 | 1.16 | 0.20 |
| 15 | 7.88 | 1.42 | 1.23 | 0.18 |
| 16 | 7.11 | 1.36 | 0.86 | 0.21 |

| Optimum Ageing Time (mins) | 0.1% Proof Stress (p.s.i × $10^3$) | 0.2% Proof Stress (p.s.i × $10^3$) | U.T.S (p.s.i × $10^3$) | Elongation % (on 250mm) | Response to Ageing (p.s.i × $10^3$) | Conductivity (% I.A.C.S) |
|---|---|---|---|---|---|---|
| 16 | 141 | 159 | 176 | 0.5 | 37 | 14.50 |
| 20 | 126 | 144 | 155 | 0.25* | 37 | 16.27 |
| 20 | 116 | 131 | 133 | 0.5* | 28.5* | 20.02 |
| 45 | 99 | 111 | 123 | 1.75 | 17.5 | 18.47 |
| 22 | 138 | 153 | 161 | 0.25* | 33 | 16.70 |
| 10 | 132 | 156 | 182 | 0.1 | 27.5 | 13.18 |
| 22 | 129 | 148 | 165 | 0.25* | 28 | 14.44 |
| 25 | 119 | 135 | 149 | 0.25 | 36.5 | 17.47 |
| 60 | 93 | — | 96 | 0.25* | 10 | 18.08 |
| 45 | 125 | 141 | 154 | 0.75 | 35 | 20.00 |
| 40 | 106 | 121 | 137 | 1.5 | 31.5 | 19.65 |
| 30 | 102 | 116 | 133 | 1.0* | 27.5 | 18.53 |
| 16 | 100 | 116 | 129 | 0.5* | 18 | 16.28 |
| 20 | 159 | 177 | 188 (201**) | 0.1 | 42.5 | 15.23 |
| 30 | 136 | 154 | 168 | 0.5 | 27.5 | 15.91 |
| 15 | 119 | 139 | 159 | —* | 30.5 | 17.33 |

*Tensile Speciment Fractures Outside its Gauge Length
**Reached on subsequent Tensile Tests

| | Typical Properties of Alloys of This Invention | | |
|---|---|---|---|
| | | Unaged | Aged |
| DENSITY | gm/cm$^3$at 20° C. | 8.694 | 8.681 |
| | lb/in$^3$at 68° F. | 0.3140 | 0.3136 |
| SPECIFIC HEAT CAPACITY | J/(kg . K) | 397 | 397 |
| | BtU/(16° F.) | 0.0948 | 0.0948 |
| THERMAL CONDUCTIVITY (0-200° C.) | W/(m . k) | 78.9 | 78.9 |
| | BtU ft$^{-1}$ h$^{-1}$ °F.$^{-1}$ | 45.6 | 45.6 |
| | Cal cm$^{-1}$ s$^{-1}$ °C.$^{-1}$ | 0.188 | 0.188 |
| MODULUS OF ELASTICITY | lbf/in$^2$ | $17 \times 10^6 \rightarrow 19 \times 10^6$ | $17 \times 10^6 \rightarrow 19 \times 10^6$ |
| | kgf/mm$^2$ | 12-13.4 | 12-13.4 |
| MAGNETIC PERMEABILITY | mOe | 1.001-1.005 | 1.001 |
| ELECTRICAL CONDUCTIVITY | % IACS | 12 | 18-20 |
| VOLUME RESISTIVITY (at ° C.) | Ω(circ mil/ft) | 1.24 | 1.87-2.07 |
| MAXIMUM WORKING TEMPS | (stable for 24 hours) | 375° C. 707° F. | 375° C. 707° F. |

The precipitation hardening alloys are solution annealed by heating them to a temperature at which the alloying metals dissolve in the host metal. If the alloy is then rapidly quenched, the alloying metals do not precipitate and an unstable, super saturated condition results. The solution annealed material is comparatively malleable and of low tensile strength and its final properties are not developed until the alloying metals are precipitated. This can be done by heat treatment (age hardening) at elevated temperatures below the solution temperature. Generally, the solution temperature of alloys of this invention are above 900° C. and a useful heat treatment temperature is about 450° C.

When work hardenable materials are deformed, as in cold rolling a strip or plate from ingots, the alloying metals are precipitated and the metal loses its ductility (strain hardened). It is necessary to solution anneal the metal between one or more passes through the rolling mill so that further deformation can be obtained.

Beryllium copper alloys are solution annealed when rolled to their final dimensions to make them ductile and permit them to be shaped as by stamping or milling operations by the user. After the part has been formed, heat treatment is required to develop the physical properties of the part. This final heat treatment step is generally undesirable not only for the time and expense it entails but because the heat treatment may cause the part to warp. Further, since heat treatment is sometimes conducted in a salt bath, the salt may, particularly at higher temperatures attack the grain boundaries which can lead to stress corrosion. Stress corrosion may cause early failure upon flexure induced by plastic deformation of the part.

Heat treatment of and by itself will not develop the full physical properties of the beryllium copper alloys. Rather, it is first necessary to work the material and deform the grain boundaries prior to the heat treatment. Typically, about 30% deformation should be achieved to condition the alloy before annealing.

In contrast to the beryllium copper alloys, the alloys of this invention do not require working prior to heat treatment, and they can be heat treated prior to shaping a finished part. Since the final properties of the alloy of this invention can be developed prior to the forming of the part, problems attendant with heat treatment, warpage and stress corrosion are avoided.

Typically, the alloys of this invention may be solution annealed at temperatures above about 950° C. at times varying from about 2 to 180 seconds (depending upon the temperature used) and then air quenched. Annealing may be accomplished in an oven at a temperature of about 450° C. and typical times may be from about 30 minutes to an hour depending upon the exact temperatures selected.

I claim:

1. A precipitation hardenable copper alloy consisting of 2 to 9 weight percent nickel, between 0.05 and 2 weight percent each of aluminum, and silicon, 0.18 to 0.50 chromium and balance copper.

2. A precipitation hardenable copper alloy according to claim 1 in which the total amount of aluminum, chromium and silicon do not exceed 2 weight percent.

3. A precipitation hardenable copper alloy according to claim 1 in which the conductivity is at least 14% I.A.C.S.

4. A precipitation hardenable copper alloy according to claim 1 in which the ultimate tensile strength is in excess of 90,000 psi.

5. A precipitation hardenable copper alloy having an ultimate tensile strength of at least 90,000 psi and a conductivity of at least 14% I.A.C.S. consisting of:

2 to 9% by weight nickel.
0.05 to 2% by weight aluminum
0.18 to 0.50% by weight chromium
0.05 to 2% by weight silicon, and
balance copper.

* * * * *